US009826584B2

(12) United States Patent
Wan et al.

(10) Patent No.: US 9,826,584 B2
(45) Date of Patent: Nov. 21, 2017

(54) POWER CIRCUIT AND DIMING CONTROL METHOD FOR LED LIGHTING DEVICE

(71) Applicant: ZHEJIANG SHENGHUI LIGHTING CO., LTD, Jiaxing (CN)

(72) Inventors: Yehua Wan, Jiaxing (CN); Lifeng Ling, Jiaxing (CN); Jinxiang Shen, Jiaxing (CN)

(73) Assignee: ZHEJIANG SHENGHUI LIGHTING CO., LTD, Jiaxing (CN)

( * ) Notice: Subject to any disclaimer, the term of this patent is extended or adjusted under 35 U.S.C. 154(b) by 0 days.

(21) Appl. No.: 15/028,787

(22) PCT Filed: Apr. 29, 2015

(86) PCT No.: PCT/CN2015/077795
§ 371 (c)(1),
(2) Date: Apr. 12, 2016

(87) PCT Pub. No.: WO2015/196863
PCT Pub. Date: Dec. 30, 2015

(65) Prior Publication Data

US 2016/0255688 A1 Sep. 1, 2016

(30) Foreign Application Priority Data

Jun. 24, 2014 (CN) ..... 2014 1 0288612

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0815; H05B 33/083; H05B 33/0812; H05B 33/0845; H05B 33/0809;
(Continued)

(56) References Cited

U.S. PATENT DOCUMENTS

2011/0127923 A1 6/2011 Lin et al.
2012/0319604 A1* 12/2012 Walters ..... H02M 3/1582 315/200 R
(Continued)

FOREIGN PATENT DOCUMENTS

CN 103313469 A 9/2013
CN 103390993 A 11/2013
(Continued)

OTHER PUBLICATIONS

The World Intellectual Property Organization (WIPO) International Search Report for PCT/CN2015/077795 dated Jul. 22, 2015.

*Primary Examiner* — Douglas W Owens
*Assistant Examiner* — Amy Yang
(74) *Attorney, Agent, or Firm* — Anova Law Group, PLLC

(57) ABSTRACT

A power circuit for an LED lighting device including an alternative current (AC) power supply, a dimmer, a transformer and a dimming control circuit. The dimming control circuit includes a filtering unit configured to filter a voltage signal outputted from the transformer and a rectifying unit configured to receive the signal outputted from the filtering unit and rectify the signal to a DC signal. The dimming control circuit also includes a boost converter unit configured to boost the received DC voltage to a needed DC voltage and a voltage feedback control circuit unit configured to control the DC voltage boosted by the boost converter unit. Further, the dimming control circuit includes a buck converter unit configured to convert the boosted DC voltage to the voltage and current needed by the LED lighting device and a digital control unit configured to automatically adjust current strength needed by the buck converter unit.

7 Claims, 3 Drawing Sheets

(58) Field of Classification Search
CPC .... H05B 37/02; H05B 33/08; H05B 33/0803; H05B 33/0821; H05B 33/0824
USPC .... 315/291–294, 191, 247, 307, 308, 185 R, 315/200 R
See application file for complete search history.

(56) References Cited

U.S. PATENT DOCUMENTS

| | | | | |
|---|---|---|---|---|
| 2013/0026924 | A1* | 1/2013 | Jong | H05B 33/0818 315/113 |
| 2013/0307424 | A1* | 11/2013 | Gray | H05B 33/083 315/193 |
| 2014/0092596 | A1* | 4/2014 | Deutsch | F21S 4/28 362/236 |
| 2014/0285099 | A1* | 9/2014 | Akahoshi | H05B 33/0815 315/200 R |
| 2015/0002038 | A1* | 1/2015 | Wan | H05B 33/0845 315/200 R |

FOREIGN PATENT DOCUMENTS

| | | | |
|---|---|---|---|
| CN | 203368837 | U | 12/2013 |
| CN | 104066247 | A | 9/2014 |
| CN | 203984733 | U | 12/2014 |
| JP | 2012-200869 | A | 10/2012 |
| JP | 2013-522837 | A | 6/2013 |
| JP | 2014-57435 | A | 3/2014 |
| KR | 10-2008-0087819 | A | 10/2008 |
| KR | 10-2011-0089094 | A | 8/2011 |

* cited by examiner

POWER CIRCUIT AND DIMING CONTROL METHOD FOR LED LIGHTING DEVICE

CROSS-REFERENCES TO RELATED APPLICATIONS

This application is a national stage application under 35 USC §371(c) of PCT Application No. PCT/CN2015/077795, entitled "Power Circuit and Diming Control Method for Led Lighting Device" filed on Apr. 29, 2015, which claims priority to Chinese Patent Application No. 201410288612.5, filed on Jun. 24, 2014. The entire disclosure and contents of the above applications are hereby incorporated by reference herein.

FIELD OF THE INVENTION

The present disclosure generally relates to the field of light emitting diode (LED) lighting technology and, more particularly, relates to a power circuit and a diming control method for an LED lighting device.

BACKGROUND

LED lighting may generally provide advantages in energy conservation, environmental protection, controllable lighting, solid state lighting, and long operational lifetime. LED lamps thus have been widely used in various areas for public, commercial, and/or indoor lighting.

Often, the LED lamps may have lamp-head structures generally-designed similar to incandescent lamps, energy saving lamps, and other conventional lamps. The LED lamps may be used to directly replace other conventional lamps by an easy installation without changing original structures of a lighting system including other conventional lamps.

However, when other conventional lamps are replaced by conventional LED lamps, dimming feature of the LED lamps may not be applied, because those other conventional lamps do not include any dimmers to implement the dimming features of the replaced LED lamps. To add a dimmer in those conventional systems can increase cost and may require complicated, additional installation.

The disclosed LED power circuits and dimming control methods are directed to solve one or more problems set forth above and other problems.

BRIEF SUMMARY OF THE DISCLOSURE

One aspect of the present disclosure includes a power circuit for an LED lighting device including an alternative current (AC) power supply, a dimmer, a transformer and a dimming control circuit. The dimming control circuit includes a filtering unit configured to filter a voltage signal outputted from the transformer and output the filtered voltage signal and a rectifying unit configured to receive the signal outputted from the filtering unit, rectify the signal to a direct current (DC) signal and output the DC signal. The dimming control circuit also includes a boost converter unit configured to receive the DC signal outputted from the rectifying unit and boost the received DC voltage to a needed DC voltage and a voltage feedback control circuit unit configured to control the DC voltage boosted by the boost converter unit. Further, the dimming control circuit includes a buck converter unit configured to convert the DC voltage boosted by the boost converter unit to the voltage and current needed by the LED lighting device and a digital control unit, which is respectively connected to the boost converter unit, the voltage feedback control circuit unit and the buck converter unit, configured to, based on the voltage at a certain point boosted by the boost converter unit and the voltage ripple, automatically adjust current strength needed by the buck converter unit, such that input power and output power are dynamically balanced and light flicker does not appear.

Another aspect of the present disclosure includes a dimming control method for an LED lighting device. The method includes turning on a power switch of an LED lighting device. The method also includes sampling voltage at a certain point boosted by a boost converter unit when a dimmer performs a dimming control operation for the LED lighting device. Further, the method includes sampling the voltage at the certain point and identifying a voltage ripple at the certain point, wherein when the voltage ripple at the certain point is greater than or equal to a preset value, a digital control unit continues sending a control signal to a buck converter unit to change current, such that the voltage ripple at the certain point is decreased until the voltage ripple is less than the preset value.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

Figure 1:
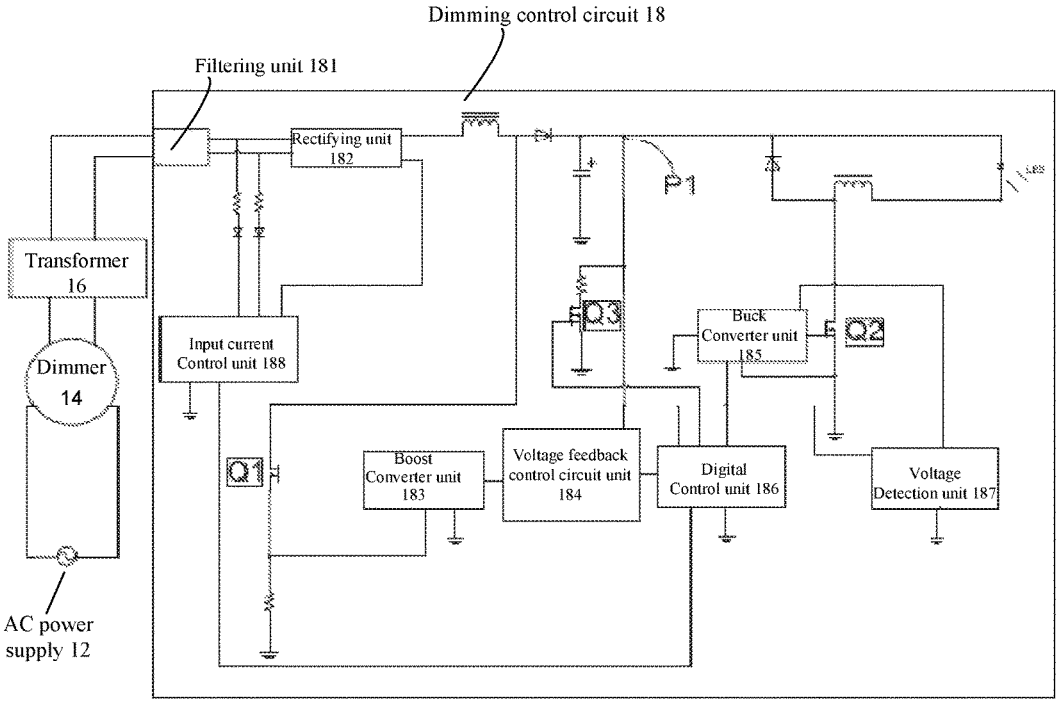
FIG. 1 illustrates a structure diagram of an exemplary LED power circuit consistent with the disclosed embodiments.

FIG. 1 illustrates a structure diagram of an exemplary LED power circuit consistent with the disclosed embodiments. The LED power circuit provided in this disclosure is an LED power circuit compatible with an electronic induction transformer and a phase cut dimmer. As shown in FIG. 1, the LED power circuit may include an alternating current (AC) power supply 12, a dimmer 14, a transformer 16 and a dimming control circuit 18. The AC power supply 12, the dimmer 14 and the transformer 16 can be existing structures that are widely used. The dimming control circuit 18 may include a filtering unit 181, a rectifying unit 182, a boost converter unit 183, a voltage feedback control circuit unit 184, a buck converter unit 185, a digital control unit 186, a voltage detection unit 187, an input current control unit 188 and an auxiliary circuit Q3.

The filtering unit 181 may be configured to filter a voltage signal outputted by the transformer and output the filtered voltage signal.

The rectifying unit 182 may be configured to receive the signal outputted by the filtering unit and rectify the inputted signal to a direct current (DC) signal.

The boost converter unit 183 may be configured to receive the signal outputted by the rectifying unit and boost the voltage to a DC voltage that is needed. The boost converter 183 is a DC-to-DC power converter with an output voltage greater than its input voltage. It is a class of switched-mode power supply (SMPS) containing at least two semiconductors (a diode and a transistor) and at least one energy storage element, a capacitor, inductor, or the two in combination.

The voltage feedback control circuit unit 184 may be configured to control the voltage that is boosted by the boost converter unit 183.

The buck converter unit 185 may be configured to convert the voltage that is boosted by the boost converter unit to the voltage and current needed by the LED lighting device. The buck converter is a voltage step down and current step down converter.

The digital control unit 186 is connected to the boost converter unit, the voltage feedback control circuit unit and the buck converter unit, respectively. The current strength of the LED lighting device is related to the dimming position of the dimmer and the voltage at point P1 where the dimming position locates. Based on the voltage and voltage ripple at point P1, the digital control unit automatically adjusts the current needed by the buck converter unit. Therefore, the input power and the output power are dynamically balanced and light flicker does not appear.

The voltage detection unit 187 is connected to the digital control unit 186 and the buck converter unit 185, respectively. The voltage detection unit 187 may be configured to sample the voltage at point P1 and convert the voltage at point P1 to an analog voltage signal, where the analog voltage signal can change a reference voltage value of the buck converter unit and the analog voltage signal is smooth without noise interference.

The input current control unit 188 is connected to the rectifying unit 182 and the digital control unit 186, respectively. The input current control unit 188 may be configured to control the input current strength. When the voltage at point P1 is decreased and is close to the lowest conduction voltage of the LED lighting device, the digital control unit 186 may turn on the input current control unit, thereby further assisting the whole dimming process and making the dimming process smoother.

The auxiliary circuit Q3 includes a field effect transistor. The field effect transistor includes a grid electrode, a drain electrode and a source electrode. The grid electrode of the field effect transistor is connected to the digital control unit 186. The drain electrode of the field effect transistor is connected to point P1 through an electric resistance. The source electrode of the field effect transistor is connected to the ground. When the voltage at point P1 is decreased and is close to the lowest conduction voltage of the LED lighting device, the digital control unit provides a high electrical level driving signal for the field effect transistor, such that a simulated load is provided under a low voltage condition.

The operating process of the power circuit of the LED lighting device is described as follows. At the beginning, the filtering unit 181 filters a voltage signal coming from the transformer 16 and outputs the filtered voltage signal to the rectifying unit 182. Then, the filtered voltage signal is rectified by the rectifying unit 182 and converted to a DC signal. The DC signal is outputted to the boost converter unit 183. The boost converter unit 183 boosts the voltage to the DC voltage that is needed. The boosted DC voltage is controlled by the voltage feedback control circuit unit. At last, the buck converter unit 185 converts the voltage to the voltage and current needed by the LED lighting device.

The dimming control process of the dimming control circuit is described as follows.

When the dimmer performs the dimming control operation for the LED lighting device, the dimming position may locate at point P1. The voltage at point P1 which is boosted by the boost converter unit 183 is sampled and sent to the voltage detection unit 187. The voltage detection unit 187 processes the sampled voltage signal and sends the processed voltage signal to the buck converted unit 185. After receiving the dimming signal, the buck converter unit 185 controls the current of the LED lighting device.

At the same time, the digital control unit 186 also samples the voltage at point P1. The digital control unit identifies the voltage ripple at point P1. If the voltage ripple at point P1 is too big, the fluctuation of the voltage detected by the voltage detection unit 187 is too big. Therefore, the voltage transmitted to the buck converter unit 185 may be unstable and the light flicker of the LED lighting device may appear.

Figure 3:
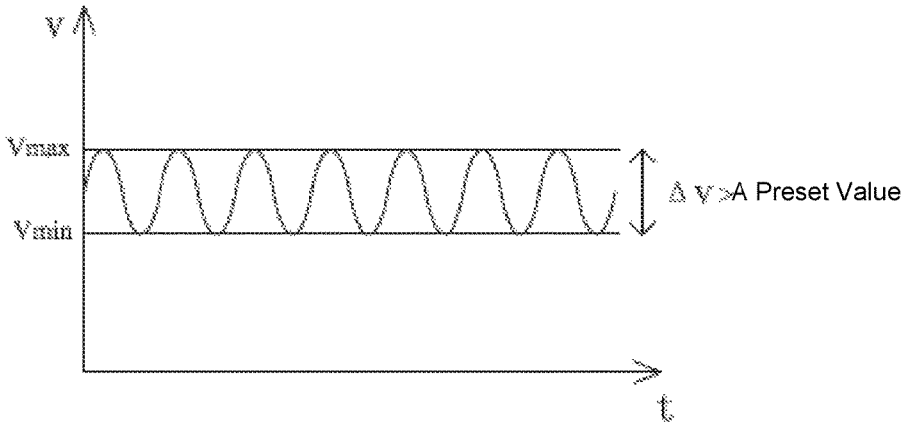
FIG. 3 illustrates a state diagram that describes a state when a voltage ripple is greater than a preset value consistent with the disclosed embodiments.
Figure 4:
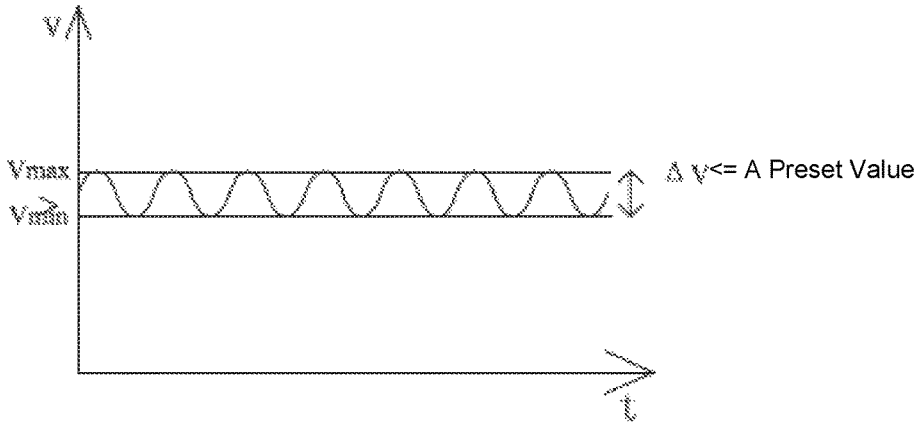
FIG. 4 illustrates a state diagram that describes a state when a voltage ripple is less than a preset value consistent with the disclosed embodiments.

FIG. 3 illustrates a state diagram that describes a state when a voltage ripple is greater than a preset value consistent with the disclosed embodiments. As shown in FIG. 3, if a voltage ripple is greater than or equal to a preset value, the digital control unit continues sending the signal to the buck converter unit, such that the buck converter unit can change the current. FIG. 4 illustrates a state diagram that describes a state when a voltage ripple is less than a preset value consistent with the disclosed embodiments. As shown in FIG. 4, a voltage ripple is decreased until the voltage ripple is less than the preset value. The current strength of the LED lighting device is related to the dimming position of the dimmer and the voltage at point P1. Based on the voltage at point P1 and the voltage ripple, the digital control unit and the voltage detection unit automatically adjust the current needed by the buck converter unit. Therefore, the input power (that is, output power of the transformer) and the output power (that is, power of the LED lighting device) are dynamically balanced and light flicker does not appear.

The voltage detection unit receives the sampled voltage at point P1 and the sampled signal is filtered. The noise interference of the sampled signal is removed and the low frequency ripple of the sampled signal is decreased. Further, the sampled signal is converted to the analog voltage signal which is smooth and without noise interference. The analog voltage signal is transmitted to the buck converter unit. The analog voltage signal can directly change the reference voltage value of the output current of the buck converter unit. When the reference voltage value of the output current of the buck converter unit changes, the output current also correspondingly changes, thereby controlling the current of the LED lighting device.

In addition, when the input current control unit detects that the input current is less than a preset current value, the input current control unit turns on the internal circuit, automatically keeping the input current at the preset value. Therefore, under a low luminance condition, the dimmer is in a continuous conduction mode, reducing the dimming flicker phenomenon.

The digital control unit can detect the voltage at point P1. When the voltage at point P1 is decreased and is close to the lowest conduction voltage of the LED lighting device, the digital control unit may turn on the input current control unit. Thus, the digital control unit controls the current strength, further assisting the dimming process and making the dimming process smoother.

The digital control unit also controls the auxiliary circuit Q3. When the voltage at point P1 is decreased and is close to the lowest conduction voltage of the LED lighting device, the digital control unit provides a driving signal for the field effect transistor of the auxiliary circuit Q3, such that a simulated load is provided under a low voltage condition. At the same time, the digital control unit provides a driving signal for the input current control unit, controlling the input current control unit to turn on under the low voltage condition. Therefore, under the low luminance condition, the dimmer is in the continuous conduction mode, reducing the dimming flicker phenomenon.

Figure 2:
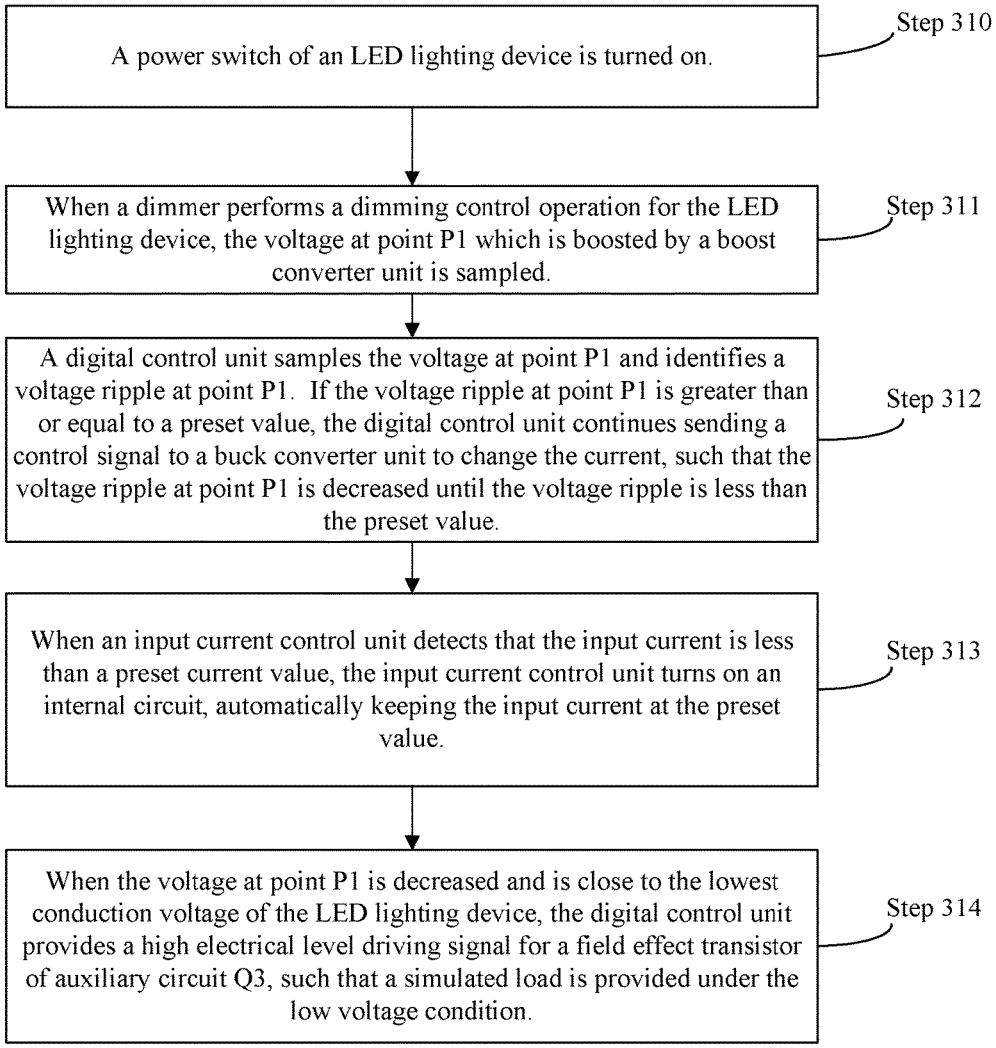
FIG. 2 illustrates a flow chart of an exemplary LED dimming control process consistent with the disclosed embodiments.

FIG. 2 illustrates a flow chart of an exemplary LED dimming control process consistent with the disclosed embodiments. As shown in FIG. 2, the process may include the following steps.

Step 310: a power switch of an LED lighting device is turned on.

Step 311: when a dimmer performs a dimming control operation for the LED lighting device, the voltage at point P1 which is boosted by a boost converter unit is sampled.

Step 312: a digital control unit samples the voltage at point P1 and identifies a voltage ripple at point P1. If the voltage ripple at point P1 is greater than or equal to a preset value, the digital control unit continues sending a control signal to a buck converter unit to change the current, such that the voltage ripple at point P1 is decreased until the voltage ripple is less than the preset value.

Step 313: when an input current control unit detects that the input current is less than a preset current value, the input current control unit turns on an internal circuit, automatically keeping the input current at the preset value. Therefore, under a low luminance condition, the dimmer is in a continuous conduction mode, reducing the dimming flicker phenomenon.

Step 314: when the voltage at point P1 is decreased and is close to the lowest conduction voltage of the LED lighting device, the digital control unit provides a high electrical level driving signal for a field effect transistor of auxiliary circuit Q3, such that a simulated load is provided under the low voltage condition.

The embodiments disclosed herein are exemplary only. Other applications, advantages, alternations, modifications, or equivalents to the disclosed embodiments are obvious to those skilled in the art and are intended to be encompassed within the scope of the present disclosure.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

A power circuit for an LED lighting device includes an AC power supply, a dimmer, a transformer and a dimming control circuit. The dimming control circuit includes a filtering unit configured to filter a voltage signal outputted from the transformer and a rectifying unit configured to receive the signal outputted from the filtering unit and rectify the signal to a DC signal. The dimming control circuit also includes a boost converter unit configured to boost the received DC voltage to a needed DC voltage and a voltage feedback control circuit unit configured to control the DC voltage boosted by the boost converter unit. Further, the dimming control circuit includes a buck converter unit configured to convert the boosted DC voltage to the voltage and current needed by the LED lighting device and a digital control unit configured to automatically adjust current strength needed by the buck converter unit.

Compared with existing technologies, the dimming process of the LED lighting device is smooth and flicker free. The current strength needed by the buck converter unit is automatically adjusted, such that the input power (that is, output power of the transformer) and the output power (that is, the power of the LED lighting device) are dynamically balanced and the light flicker phenomenon does not appear.

REFERENCE SIGN LIST

AC power supply 12
Dimmer 14
Transformer 16
Dimming control circuit 18
Filtering unit 181
Rectifying unit 182
Boost converter unit 183
Voltage feedback control circuit unit 184
Buck converter unit 185
Digital control unit 186
Voltage detection unit 187
Input current control unit 188
Auxiliary circuit Q3

What is claimed is:

1. A power circuit for a light emitting diode (LED) lighting device including an alternative current (AC) power supply, a dimmer, a transformer and a dimming control circuit, wherein the dimming control circuit includes:

a filtering unit configured to filter a voltage signal outputted from the transformer and output the filtered voltage signal;

a rectifying unit configured to:

receive the signal outputted from the filtering unit;

rectify the signal to a direct current (DC) signal; and output the DC signal;

a boost converter unit configured to receive the DC signal outputted from the rectifying unit and boost the received DC voltage to a needed DC voltage;

a voltage feedback control circuit unit configured to control the DC voltage boosted by the boost converter unit;

a buck converter unit configured to convert the DC voltage boosted by the boost converter unit to the voltage and current needed by the LED lighting device; and a digital control unit, which is respectively connected to the boost converter unit, the voltage feedback control circuit unit and the buck converter unit, configured to automatically adjust current strength needed by the buck converter unit based on the voltage at a certain point boosted by the boost converter unit and the voltage ripple, such that input power and output power are dynamically balanced and light flicker does not appear.

2. The power circuit according to claim 1, wherein the dimming control circuit further includes:

a voltage detection unit, which is respectively connected to the digital control unit and the buck converter unit, configured to:

sample a voltage at the certain point; and convert the sampled voltage to an analog voltage signal which without noise interference and is used to change a reference voltage value of the buck converter unit.

3. The power circuit according to claim 1, wherein the dimming control circuit further includes:

an input current control unit, which is respectively connected to the rectifying unit and the digital control unit, configured to control strength of the input current, wherein:

when the voltage at the certain point is decreased and is close to a lowest conduction voltage of the LED lighting device, the digital control unit turns on the input current control unit, thereby further assisting a dimming process and making the dimming process smooth.

4. The power circuit according to claim 1, wherein the dimming control circuit further includes:

an auxiliary circuit which includes a field effect transistor, wherein:

a grid electrode of the field effect transistor is connected to the digital control unit;

a drain electrode of the field effect transistor is connected to the certain point through an electric resistance;

a source electrode of the field effect transistor is connected to the ground; and when the voltage at the certain point is decreased and is close to the lowest conduction voltage of the LED lighting device, the digital control unit provides a high electrical level driving signal for the field effect transistor, such that a simulated load is provided under a low voltage condition.

5. A dimming control method for an LED lighting device, comprising:

turning on a power switch of an LED lighting device;

when a dimmer performs a dimming control operation for the LED lighting device, sampling voltage at a certain point boosted by a boost converter unit;

identifying a voltage ripple at the certain point;

sending, by a digital control unit, a control signal to a buck converter unit to change current when the voltage ripple at the certain point is greater than or equal to a preset value, so that the voltage ripple at the certain point is decreased to less than the preset value; and when an input current control unit detects that the input current is less than a preset current value, turning on an internal circuit and automatically keeping the input current at the preset value, such that the dimmer is in a continuous conduction mode under a low luminance condition and dimming flicker phenomenon is reduced.

6. The method according to claim 5, further including:

when the voltage at the certain point is decreased and is close to the lowest conduction voltage of the LED lighting device, providing a high electrical level driving signal for the field effect transistor, such that a simulated load is provided under a low voltage condition.

7. The method according to claim 5, wherein:

when a voltage detection unit receives the sampled signal at the certain point and the sampled signal is filtered, the noise interference of the sampled signal is removed and the low frequency ripple of the sampled signal is decreased;

the sampled signal is converted to an analog voltage signal without noise interference;

the analog voltage signal is transmitted to the buck converter unit;

the analog voltage signal directly changes a reference voltage value of the output current of the buck converter unit; and when the reference voltage value of the output current of the buck converter unit changes, the output current also correspondingly changes, such that the current of the LED lighting device is controlled.

* * * * *